United States Patent [19]

Okumura et al.

[11] 3,951,877

[45] Apr. 20, 1976

[54] HEAVY-DUTY GRANULAR DETERGENT COMPOSITION WITH SODIUM CITRATE BUILDER

[75] Inventors: Osamu Okumura, Funabashi; Kazuo Ohbu, Tokyo; Mitsuharu Kachi, Ichikawa; Masuzo Nagayama, Tokyo, all of Japan

[73] Assignee: Lion Fat & Oil Co., Ltd., Tokyo, Japan

[22] Filed: July 13, 1973

[21] Appl. No.: 378,922

[30] Foreign Application Priority Data

July 17, 1972 Japan ..... 47-071934

[52] U.S. Cl. ..... 252/526; 252/89 R; 252/135; 252/530; 252/531; 252/535; 252/536; 252/539; 252/545; 252/549; 252/550; 252/554; 252/555; 252/558

[51] Int. Cl.[2] ..... C11D 3/08; C11D 3/04; C11D 1/22; C11D 1/14

[58] Field of Search ..... 252/89, 539, 549, 558, 252/530, 531, 535, 536, 526, 545, 550, 554, 555, 135

[56] References Cited

UNITED STATES PATENTS

| | | | |
|---|---|---|---|
| 3,686,098 | 8/1972 | Weil | 252/558 X |
| 3,692,684 | 9/1972 | Hentschel | 252/89 |
| 3,769,222 | 10/1973 | Yurko et al. | 252/89 |
| 3,798,168 | 3/1974 | Tumerman | 252/89 |
| 3,844,982 | 10/1974 | Connor et al. | 252/89 X |

*Primary Examiner*—Leland A. Sebastian
*Assistant Examiner*—E. A. Miller
*Attorney, Agent, or Firm*—Woodhams, Blanchard and Flynn

[57] ABSTRACT

A heavy-duty granular detergent composition consisting of 10 to 60 wt. percent of sodium citrate, 5 to 40 wt. percent of non-soap anionic surfactants, 0.1 to 10 wt. percent of inorganic aluminum salts and additives for use in conventional detergents, the weight ratio of the citrate to the surfactants being 1/5 to 10/1.

3 Claims, No Drawings

HEAVY-DUTY GRANULAR DETERGENT COMPOSITION WITH SODIUM CITRATE BUILDER

BACKGROUND OF THE INVENTION

1. Field of the Invention

This invention relates to a heavy-duty granular detergent composition capable of preventing eutrophication of river water due to inflow of waste water after washing and also capable of preventing particles from pulverization during the transportation of packaging.

2. Description of the Prior Art

Sodium citrate is known as an effective builder for heavy-duty granular detergents. However, a detergent formulation of this type having a granule strength equal or superior to that of the heavy-type granular detergent comprising sodium tripolyphosphate (STPP) as a builder and having a particle shell strength (i.e. the ultimate strength of a single particle pressed between two parallel surfaces) equal to 4 to 5 g and thus capable of maintaining the spherical granule shape in the course of charging into a container or transport, has not hitherto been known. The product comprising particles of a fairly hollow shape can be produced by spray-drying a slurry containing 5 – 60 wt. percent of sodium citrate prepared by the same process as that of a known detergent containing the same amount of STPP builder. In this case, however, the shell strength of the resulting particle is decidedly inferior as compared to that of the known STPP detergent and amounts only to about 1 to 2 g.

A granular detergent of this type is marketed in the form of a package in a carton, box and the like. If the granule strength of the detergent is low, the detergent granules are apt to be broken into smaller sizes due to heavy vibration caused in the course of handling or transport. Pulverization of a granules so caused results in the decrease of the apparent volume of the granular detergent and detracts from its commercial value. In order to increase the granule strength and to prevent granules from pulverization, the drying capacity is decreased, or sodium tripolyphosphate is added in a larger amount. The former method is however not desirable as it lowers the production efficiency of the granular detergent, and the latter has the deficiency that eutrophication of river water due to inflow of detergent components may be promoted.

SUMMARY OF THE INVENTION

The present invention provides a heavy-duty granular detergent composition with a granule strength equal of superior to that made with STPP builder.

The present invention provides a heavy-duty granular detergent composition capable of retaining a hollow and spherical particle shape even during charging into a container or transport, thus preventing the formation of fine dusts during charging and an increase in bulk density caused by vibration during transport and hence preventing detraction of the detergent's commercial value.

The present invention also provides an economical granular detergent through the use of less costly inorganic aluminium salts.

The present invention also provides a granular detergent possessing the property that eutrophication of river water due to inflow of waste water can be prevented.

The heavy-duty granular detergent composition according to the present invention consists of 10 to 60 wt. percent of sodium citrate, 5 to 40 wt. percent of non-soap anionic surfactants and 0.1 to 10 wt. percent of inorganic aluminum salts, the balance being the additives for use in conventional detergents, and the weight ratio of the citrate to the surfactants being 1/5 to 10/1.

The detergent of this invention can be produced by spray-drying an aqueous slurry prepared from the above-mentioned components in the same way as for conventional heavy-duty granular detergents. During preparation of the aqueous slurry, special attention should be exercised so that the aluminum salt may be dispersed in the aqueous slurry as uniformly as the other components. Therefore, the aluminum salt should be sufficiently agitated when mixed with other slurry components or, more preferably, it should be dissolved in warm water in advance of mixing. The aluminum salt has the marked property of improving the strength of the detergent particles, but it may be used in a quantity of 0.1 to 10 and preferably 1 to 5 wt. percent. The granule strength increases with the addition of the aluminum salt up to 10 wt. percent. The detergent admixed with less than 10 wt. percent of aluminum salt has the same detergency as a detergent not admixed with the aluminum salt, but a decrease in detergency can be observed when more than 10 wt. percent of the aluminum salt is used. This may possibly be ascribed to the fact that the citrate ions having the property of effectively removing soil fixed on the textile are present in the detergent solution so long as these ions are consumed to a lesser extent for sequestration of aluminum, but the quantity of effective sodium citrate available for the removal of soil rapidly decreases with an increase in the quantity of dissolved aluminum. As soon as the amount of the aluminum salt exceeds 10 wt. percent, the rate of dissolution of the detergent admixed with aluminum salt and sodium citrate is lowered and an insoluble matter is recognized to exist in cold water.

According to the present invention, the non-soap-based anionic surfactants are used in the range of 5 to 40 wt. percent. When the surfactants are used in excess of 40 wt. percent, the property of the detergent composition is definitely influenced by that of the surfactants, and the addition of aluminum salts will not lead to an improved granule strength. It is to be noted that the uniform hollow granules may not be obtained by the use of soap-based surfactants.

Sodium citrate is added preferably in the range of 10 to 60 wt. percent. Generally, when sodium citrate is added in more than 60 wt. percent, the resulting product is softened and is apt to agglomerate by residual heat immediately after spray-drying and the free-flowing property of the granules may be definitely reduced. On the other hand, addition up to 60 wt. percent may be allowed in the case of the present invention.

In adding sodium citrate and anionic surfactants, the weight ratio of sodium citrate to anionic surfactants should be in the range of 1/5 to 10/1. When the ratio of sodium citrate to anionic surfactants exceeds the above value, the increase in detergency reaches a point of saturation, and the excess surfactants will become useless. When the anionic surfactants are used in a lesser quantity than that determined by the above ratio, the fatty soil can be washed off only with great difficulty.

Among the anionic surfactants to be employed in the present invention are sodium linear alkylbenzene sulfonate (LAS) with 11 to 15 carbon atoms; sodium α-olefinsulfonate (AOS) with 12 to 20 carbon atoms; sodium alkylsulfate (AS) with 10 to 18 carbon atoms; sodium alkane sulfonate with 12 to 20 carbon atoms; acylated sodium taurate with 12 to 18 carbon atoms; and acylated sodium sulfo-succinate with 10 to 18 carbon atoms. Among the aluminum salts are aluminum sulfate; aluminum sodium sulfate; aluminum nitrate; sodium aluminum silicates or their hydrate; aluminum hydroxide; aluminum silicates or their hydrates; and aluminum oxide etc.

Among the additives utilizable in the present invention are sodium sulfate; sodium silicate; sodium carbonate; carboxy methyl cellulose; fluorescent whitening agents; bleaching agents; textile softening agent; and perfume etc.

The reason why the detergent of this invention has an improved granule strength as compared to the conventional product using no aluminum salts is very complicated but it may be explained as follows. The detergent composition of the present invention is a system in which a number of organic and inorganic substances and high molecular polymers coexist. Moreover, as the detergent is prepared by spray-drying an aqueous slurry prepared from these components, part of the salts added to the system are naturally dissociated and undergo an ion-exchange process. Since sodium sulfate usually added to the detergent composition and the aluminum salts such as aluminium sulfate have the sulfate anion in common, a complex interaction occurs in the slurry between aluminum cations in particular and the respective detergent components, and the detergents with an increased granule strength are thus produced partially through cationic exchange process. The detergent composition of the present invention has a considerable content of hygroscopic material that can hardly be formed into orderly crystals, such as sodium silicate. Sodium citrate coexists with a considerable quantity of this hardly crystallizable material and other components, but it remains in an amorphous state even after the process of spray-drying. On the contrary, when an aqueous slurry is prepared from the above-mentioned non-crystalline material and other components with the conventional STPP builder and the slurry is then subjected to a spray-drying operation, the resulting product is the hexa-hydrate crystal structure and has excellent crystallizability, thus possibly leading to the improved strength of the crystal granules of the detergent. Therefore, the granules with high crystal strength cannot be obtained by simply using sodium citrate in place of STPP in the conventional STPP detergent. The present invention provides improved crystal strength in the detergent thanks to the presence of co-existing aluminum salt, such as aluminum sulfate, capable of forming a double salt with various other ions and producing various hydrated crystals, despite the fact that sodium citrate remains in the amorphous state even after spray-drying.

PREFERRED EMBODIMENTS OF THE INVENTION

Comparative Examples 1 to 3

Granular detergents having the composition given in the below were prepared respectively by spray-drying, which were carried out in a way such that aqueous slurries were first prepared with 65 percent solid content of the component materials and the slurries were then sprayed through a nozzle of a spray drier heated by a hot air of 350°C.

The following anionic surfactants were used in the test.

LAS: straight-chain sodium alkylbenzensulfonate (alkyl chain length : $C_{12}$ to $C_{15}$)

AOS: sodium α-olefinesulfonate (olefine chain length : $C_{16}$ to $C_{18}$)

AS: straight-chain sodium alkylsulfate (alkyl chain length : $C_{14}$ to $C_{15}$)

The granular detergents thus obtained invariably had the bulk density of $0.31 \pm 0.02$ g/ml.

The detergents thus obtained were allowed to stand at room temperature for 24 hours and the granule strength was measured by using the following two methods.

METHOD 1:

A carton box ($3 \times 10.5 \times 8$ cm) charged with 50 g of test sample was placed on a KM-type universal shaker (Type RV-2 manufactured by Iwaki Kagaku K. K. of Japan) and subjected to vibration with 300 r.p.m. for 30 minutes. The test sample was spread on a 100 - mesh screen and the quantity of test sample that passed through the screen was weighed. From this weighed quantity was subtracted the quantity of another test sample which was likewise allowed to pass through the 100 - mesh screen, the latter sample being not subjected in advance to the vibration process. The granule strength was expressed as the weight ratio (percent) of the difference of the two weighed quantities to 50 g of the charged sample. The smaller the value of this ratio, the lesser is the degree of granule destruction.

METHOD 2:

The particles in the range of 20 to 30 meshes were collected and 200 particles were selected at random from these particles. Then, the distribution of maximum load to be withstood by a single granule placed between two parallel surfaces was measured by the use of a particle hardness meter (strain gauge type manufactured by Ueshima Seisakusho of Japan).

The granule composition and the results obtained by the two test methods are given below.

| Composition | Comparative Example 1 | Comparative Example 2 | Comparative Example 3 |
|---|---|---|---|
| anionic surfactant | LAS 20 wt.% | AOS 20 wt.% | AS 20 wt.% |
| builder | sodium tripolyphosphate 25 wt.% | | |
| sodium silicate | 10 wt.% ($SiO_2/N_2O = 2.0$) | | |
| carboxymethylcellulose | 1 " | | |
| sodium toluene sulfonate | 2 " | | |
| moisture | 10 " | | |
| sodium sulphate | balance | | |

| | Comparative Example 1 | Comparative Example 2 | Comparative Example 3 |
|---|---|---|---|

-continued

| Composition | | Comparative Example 1 | Comparative Example 2 | Comparative Example 3 |
|---|---|---|---|---|
| | method 1) rate of increase in the passed quantity through 100 mesh | 12% | 11% | 11% |
| results of | less than 1 g | 6 | 11 | 9 |
| measurement | 1 g or more to less than 2 g | 5 | 4 | 13 |
| | 2 g or more to less than 3 g | 25 | 21 | 28 |
| max. load | 3 g or more to less than 4 g | 39 | 43 | 38 |
| distribution | 4 g or more to less than 5 g | 48 | 44 | 40 |
| | 5 g or more to less than 6 g | 32 | 36 | 29 |
| method 2) | 6 g or more to less than 7 g | 24 | 20 | 30 |
| | 7 g or more | 21 | 19 | 13 |
| | mean maximum load | 4.44 g | 4.65 g | 4.46 g |

EXAMPLES 1 TO 22 AND COMPARATIVE EXAMPLES 4 TO 8

The favorable effect of each inorganic aluminum salt on the granule strength of the granular detergent admixed with 30 wt. percent of sodium citrate is shown below.

The component materials other than sodium citrate and the spray-drying conditions were the same as in the Comparative Examples 1 to 3.

The solubility and detergency tests were conducted by using the following methods.

i. The method of solubility test and visible state of solution 1 lit. of water at 25°C was filled in a 2 lit. beaker to which granular detergent weighed accurately to 2 g was added. The mixture was then immediately stirred vigorously for 10 minutes by using a magnetic stirrer. Then the transparency of the liquid was observed (visible state of solution), and the nonsoluble contents in the liquid were collected with a Millipore filter (0.45 $\mu$) whose weight was measured beforehand. The nonsoluble contents collected on the filter were thoroughly washed with water while they were sucked up and dried to a constant weight in an oven maintained at a constant temperature of 105°C. The solubility of the detergent was expressed as the ratio of increment of the filter weight of residual water insoluble matter to the weight of the sampled granular detergent. The smaller the value of this ratio, the lesser the insoluble matter.

ii. Detergency test

The detergency was measured by the following method with the use of an artificially soiled test cloth which was prepared in the way propounded in a lecture entitled "New artificially soiled cloth" which was delivered on Apr. 23 – 26, 1972 in a joint meeting of the American Oil Chemists' Society and Japan Oil Chemists' Society. 10 artificially soiled swatches were washed for 10 minutes by using a Terg - O - Tometer (U.S. Testing Company Inc.) at 150 r.p.m. and with the detergent solution of 900 cc kept at 25°C and loading ratio 30. A cloth affixed with 0.6 percent of organic components of artificial sebum was used for balancing the loading ratio. Rinsing was conducted for 3 minutes under the same conditions as for washing. The detergency was determined by the following formula on the basis of the measured values of reflectance of the soiled swatches before and after washing.

$$\text{Detergency (\%)} = \frac{Rw - Rs}{Ro - Rs} \times 100$$

where Ro stands for reflectance (%) of the unsoiled cloth, Rs reflectance (%) of the soiled swatch before washing, and Rw reflectance (%) of the soiled swatch after washing.

| composition | Comp. ex. 4 | Ex. 1 | Ex. 2 | Ex. 3 | Ex. 4 | Comp. ex. 5 | Comp. ex. 6 |
|---|---|---|---|---|---|---|---|
| anionic surfactant | | | | LAS 20 wt.% | | | |
| sodium citrate | | | | 30 " | | | |
| sodium silicate | | | | 10 " | | | |
| carboxy-methyl cellulose | | | | 1 " | | | |
| sodium toluene sulfonate | | | | 2 " | | | |
| aluminum salts | (a) wt.% 0 | (a) wt.% 0.5 | (a) wt.% 3 | (a) wt.% 6 | (a) wt.% 9 | (a) wt.% 12 | (a) wt.% 15 |
| moisture | | | | 10 wt.% | | | |
| sodium sulfate | | | | balance | | | |
| method 1) rate of increase in passed quantity through 100 mesh | 37% | 17% | 14% | 10% | 16% | 11% | 12% |
| method 2) | | | | max. load distribution | | | |
| less than 1g | 68 | 13 | 8 | 7 | 4 | 7 | 10 |

-continued

| composition | Comp. ex. 4 | Ex. 1 | Ex. 2 | Ex. 3 | Ex. 4 | Comp. ex. 5 | Comp. ex. 6 |
|---|---|---|---|---|---|---|---|
| 1g or more to less than 2g | 57 | 11 | 15 | 6 | 13 | 16 | 18 |
| 2g or more to less than 3g | 49 | 31 | 29 | 23 | 26 | 25 | 30 |
| 3g or more to less than 4g | 18 | 39 | 37 | 31 | 29 | 32 | 47 |
| 4g or more to less than 5g | 5 | 46 | 42 | 47 | 44 | 43 | 38 |
| 5g or more to less than 6g | 0 | 29 | 33 | 41 | 36 | 40 | 35 |
| 6g or more to less than 7g | 2 | 20 | 21 | 27 | 30 | 17 | 17 |
| 7g or more | 1 | 11 | 15 | 18 | 21 | 20 | 5 |
| mean max. load | 1.75 g | 3.54 g | 4.45 g | 4.86 g | 4.95 g | 4.63 g | 3.98 g |

| composition | Comp. ex. 7 | EX. 5 | Ex. 6 | Comp. ex. 8 | Ex. 7 | Ex. 8 |
|---|---|---|---|---|---|---|
| anionic surfactant | AOS 20 wt.% | | | AS 20 wt.% | | |
| sodium citrate | 30 " | | | 30 " | | |
| sodium silicate | 10 " | | | 10 " | | |
| carboxy-methyl cellulose | 1 " | | | 1 " | | |
| sodium toluene sulfonate | 2 " | | | 2 " | | |
| aluminum salts | (a) wt.% 0 | (a) wt.% 4 | (a) wt.% 8 | (a) wt.% 0 | (a) wt.% 4 | (a) wt.% 8 |
| moisture | 10 wt.% | | | | | |
| sodium sulfate | balance | | | | | |
| method 1) rate of increase in passed quantity through 100 mesh | 35% | 14% | 13% | 31% | 15% | 12% |
| method 2) | max. load distribution | | | | | |
| less than 1g | 71 | 6 | 9 | 70 | 2 | 4 |
| 1g or more to less than 2g | 59 | 6 | 13 | 68 | 11 | 10 |
| 2g or more to less than 3g | 43 | 28 | 19 | 46 | 29 | 33 |
| 3g or more to less than 4g | 15 | 37 | 44 | 10 | 42 | 41 |
| 4g or more to less than 5g | 2 | 39 | 49 | 4 | 49 | 51 |
| 5g or more to less than 6g | 6 | 52 | 49 | 1 | 36 | 39 |
| 6g or more to less than 7g | 3 | 10 | 3 | 0 | 18 | 12 |
| 7g or more | 1 | 22 | 14 | 1 | 13 | 10 |
| mean max. load | 1.78 g | 4.79 g | 4.38 g | 1.60 g | 4.51 g | 4.33 g |

| composition | Ex. 9 | Ex. 10 | Ex. 11 | Ex. 12 |
|---|---|---|---|---|
| anionic surfactant | LAS 5 wt.% | LAS 30 wt.% | AOS 5 wt.% | AOS 30 wt.% |
| sodium citrate | 45 wt.% | 20 wt.% | 45 wt.% | 20 wt.% |
| sodium silicate | | | | |
| carboxy-methyl cellulose | 1 " | | 1 " | |
| sodium toluene sulfonate | 2 " | | 2 " | |

-continued

| composition | Comp. ex. 4 | Ex. 1 | Ex. 2 | Ex. 3 | Ex. 4 | Comp. ex. 5 | Comp. ex. 6 |
|---|---|---|---|---|---|---|---|
| aluminum salts | (a) 5 " | | | (a) 5 " | | | |
| moisture | | | 10 wt.% | | | | |
| sodium sulfate | | | balance | | | | |
| method 1) rate of increase in passed quantity through 100 mesh | 11 | | 16 | 12 | | 16 | |
| method 2) | | | max. load distribution | | | | |
| less than 1g | 5 | | 12 | 8 | | 13 | |
| 1g or more to less than 2g | 8 | | 9 | 7 | | 15 | |
| 2g or more to less than 3g | 27 | | 31 | 22 | | 30 | |
| 3g or more to less than 4g | 40 | | 44 | 40 | | 28 | |
| 4g or more to less than 5g | 39 | | 48 | 42 | | 47 | |
| 5g or more to less than 6g | 54 | | 42 | 39 | | 36 | |
| 6g or more to less than 7g | 15 | | 10 | 26 | | 1 | |
| 7g or more | 12 | | 4 | 16 | | 10 | |
| mean max. load | 4.56g | | 4.02g | 4.71g | | 3.94g | |

| composition | Ex. 13 | Ex. 14 | Ex. 15 | Ex. 16 | Ex. 17 |
|---|---|---|---|---|---|
| anionic surfactant | LAS 20 wt.% | | | LAS 20 wt.% | |
| sodium citrate | 30 " | | | | 30 " |
| sodium silicate | 10 " | | | | 10 " |
| carboxy-methyl cellulose | 1 " | | | | 1 " |
| sodium toluene sulfonate | 2 " | | | | 2 " |
| aluminum salts | (b) 0.5 wt.% | (c) 3 wt.% | (d) 6 wt.% | (e) 9 wt.% | (f) 3 wt.% |
| moisture | | | 10 wt.% | | |
| sodium sulfate | | | balance | | |
| method 1) rate of increase in passed quantity through 100 mesh | 19% | 12% | 13% | 15% | 18% |
| method 2) | | | max. load distribution | | |
| less than 1g | 21 | 11 | 5 | 3 | 16 |
| 1g or more to less than 2g | 36 | 22 | 14 | 16 | 25 |
| 2g or more to less than 3g | 40 | 33 | 22 | 17 | 18 |
| 3g or more to less than 4g | 51 | 35 | 32 | 21 | 13 |
| 4g or more to less than 5g | 15 | 19 | 26 | 48 | 34 |
| 5g or more to less than 6g | 18 | 37 | 46 | 43 | 35 |
| 6g or more to less than 7g | 12 | 25 | 41 | 44 | 48 |
| 7g or more | 7 | 18 | 14 | 8 | 11 |
| mean max. load | 3.20 g | 4.15 g | 4.66 g | 4.70 g | 4.38 g |

-continued

| composition | Comp. ex. 4 | Ex. 1 | Ex. 2 | Ex. 3 | Ex. 4 | Comp. ex. 5 | Comp. ex. 6 |
|---|---|---|---|---|---|---|---|
| composition | Ex. 18 | Ex. 19 | Ex. 20 | Ex. 21 | Ex. 22 | | |
| anionic | AOS 20 wt.% | | AS 20 wt.% | | LAS 30 wt.% | | |
| sodium citrate | 30 wt.% | | 30 wt.% | | 20 wt.% | | |
| sodium silicate | 10 wt.% | | 10 wt.% | | 10 wt.% | | |
| carboxy-methyl cellulose | 1 wt.% | | 1wt% | | 1 wt.% | | |
| sodium toluene sulfonate | 2 wt.% | | 2 wt.% | | 2 wt.% | | |
| aluminum salts | (g) wt.% 4 | (h) wt.% 8 | (i) wt.% 4 | (j) wt.% 8 | (k) wt.% 5 | | |
| moisture | 10 wt.% | | | | | | |
| sodium sulfate | balance | | | | | | |
| method 1) rate of increase in passed quantity through 100 mesh | 14% | 17% | 12% | 16% | 13% | | |
| method 2) | max. load distribution | | | | | | |
| less than 1g | 14 | 9 | 6 | 7 | 12 | | |
| 1g or more to less than 2g | 14 | 12 | 19 | 13 | 22 | | |
| 2g or more to less than 3g | 18 | 24 | 23 | 18 | 24 | | |
| 3g or more to less than 4g | 29 | 27 | 29 | 25 | 34 | | |
| 4g or more to less than 5g | 43 | 36 | 45 | 32 | 37 | | |
| 5g or more to less than 6g | 49 | 44 | 31 | 50 | 31 | | |
| 6g or more to less than 7g | 25 | 31 | 34 | 31 | 25 | | |
| 7g or more | 8 | 17 | 13 | 24 | 15 | | |
| mean max. load | 4.30 g | 4.55 g | 4.41 g | 4.78 g | 4.15 g | | |

| | Comp. ex. 4 | Ex. 1 | Ex. 2 | Ex. 3 | Ex. 4 |
|---|---|---|---|---|---|
| visible state of solution | very unperceptibly turbid | | | | |
| solubility (insoluble %) | less than 0.1 | 0.2 | 1.1 | 1.9 | 2.5 |
| detergency (%) | 92 | 91 | 93 | 91 | 92 |

| | Comp. ex. 5 | Comp. ex. 6 | Comp. ex. 7 | Ex. 5 | Ex. 6 |
|---|---|---|---|---|---|
| visible state of solution | unperceptibly turbid | | slightly turbid | | |
| solubility (insoluble %) | 4.0 | 5.2 | less than 0.1 | 1.3 | 2.3 |
| detergency (%) | 87 | 81 | 93 | 92 | 94 |

| | Comp. ex. 8 | Ex. 7 | Ex. 8 | Ex. 9 | Ex. 10 |
|---|---|---|---|---|---|
| visible state of solution | slightly turbid | | | slightly turbid | |
| solubility (insoluble %) | less than 0.1 | 1.2 | 2.4 | 1.9 | 2.1 |
| detergency (%) | 91 | 92 | 91 | 78 | 82 |

| | Ex. 11 | Ex. 12 | Ex. 13 | Ex. 14 | Ex. 15 |
|---|---|---|---|---|---|
| visible state of solution | slightly turbid | | very unperceptibly turbid | | |
| solubility | | | | | |

-continued

| composition | Comp. ex. 4 | Ex. 1 | Ex. 2 | Ex. 3 | Ex. 4 | Comp. ex. 5 | Comp. ex. 6 |
|---|---|---|---|---|---|---|---|
| (insoluble %) | 2.0 | 2.2 | 0.3 | 1.4 | 1.6 | | |
| detergency (%) | 76 | 85 | 93 | 91 | 92 | | |
| | Ex. 16 | Ex. 17 | Ex. 18 | Ex. 19 | | | |
| visible state of solution | very unperceptibly turbid | | | slightly turbid | | | |
| solubility (insoluble %) | 2.1 | 1.3 | 1.8 | 1.6 | | | |
| detergency (%) | 93 | 92 | 91 | 92 | | | |
| | Ex. 20 | | Ex. 21 | Ex. 22 | | | |
| visible state of solution | slightly turbid | | | | | | |
| solubility (insoluble %) | 1.3 | | 2.1 | 1.7 | | | |
| detergency (%) | 93 | | 90 | 91 | | | |

note:
inorganic aluminum salts
(a) Aluminum Sulfate
(b) Aluminum Hydroxide
(c) Aluminum Silicate Hydrate
(d) Aluminum Sodium Sulfate
(e) Aluminum Potassium Sulfate
(f) Aluminum oxide having a particle size of 300 mesh pass
(g) Sodium Aluminum Silicate Hydrate
(h) Sodium Aluminum Silicate Sulfate
(i) Basic Sodium Aluminum Carbonate
(j) Sodium Aluminum Carbonate Silicate
(k) Sodium Aluminum Silicate

What is claimed is:

1. A heavy-duty granular detergent having the form of free-flowing, generally hollow and spherical particles having a particle shell strength effective to minimize pulverization of the particles during packaging and transportation, prepared by spray drying an aqueous slurry of a detergent composition consisting essentially of 10 to 60 wt. percent of sodium citrate, 5 to 40 wt. percent of non-soap anionic surfactant, the weight ratio of sodium citrate to said surfactant being in the range of from 1:5 to 10:1, 0.1 to 10 wt. percent of an inorganic aluminum substance selected from the group consisting of aluminum salts, aluminum oxide and aluminum hydroxide, and the balance is sodium sulfate or sodium sulfate and sodium silicate.

2. A detergent composition according to claim 1 wherein said non-soap anionic surfactant is selected from the group consisting of $C_{11}$ to $C_{15}$ straight-chain sodium alkylbenzenesulfonates, $C_{12}$ to $C_{20}$ sodium $\alpha$-olefinsulfonates, $C_{10}$ to $C_{18}$ straight-chain sodium alkylsulfates, $C_{12}$ to $C_{20}$ sodium alkane sulfonates, $C_{12}$ to $C_{18}$ acylated sodium taurates and $C_{10}$ to $C_{18}$ acylated sodium sulfo succinates, and the inorganic aluminum substance is selected from the group consisting of aluminum sulfate, aluminum sodium sulfate, aluminum potassium sulfate, aluminum nitrate, sodium aluminum silicates and their hydrates, aluminum hydroxide, aluminum silicates and their hydrates, aluminum oxide, sodium aluminum silicate sulfate, basic sodium aluminum carbonate and sodium aluminum carbonate silicate.

3. A detergent according to claim 2 wherein the amount of said inorganic aluminum substance is from 1 to 5 wt. percent.

* * * * *